United States Patent [19]

Glenn

[11] 4,292,810

[45] Oct. 6, 1981

[54] GAS TURBINE COMBUSTION CHAMBER

[75] Inventor: Robert G. Glenn, Lower Moreland Township, Montgomery County, Pa.

[73] Assignee: Westinghouse Electric Corp., Pittsburgh, Pa.

[21] Appl. No.: 8,318

[22] Filed: Feb. 1, 1979

[51] Int. Cl.[3] ..... F02C 7/20

[52] U.S. Cl. ..... 60/757

[58] Field of Search ..... 60/39.66, 39.65, 39.32, 60/757, 756

[56] References Cited

U.S. PATENT DOCUMENTS

| | | | |
|---|---|---|---|
| 2,722,801 | 11/1955 | Lombard | 60/39.32 X |
| 2,958,194 | 11/1960 | Bayley | 60/39.66 X |
| 3,420,058 | 1/1969 | Howald et al. | 60/39.66 |
| 3,572,031 | 3/1971 | Szetela | 60/39.66 X |
| 3,702,058 | 11/1972 | De Corso et al. | 60/39.66 X |
| 3,738,106 | 6/1973 | Stein | 60/39.65 X |
| 3,851,465 | 12/1974 | Verdouw | 60/39.66 X |
| 3,899,876 | 8/1975 | Williamson | 60/39.66 |
| 4,050,241 | 9/1977 | DuBell | 60/39.66 |
| 4,064,300 | 12/1977 | Bhangu | 60/39.66 X |
| 4,109,459 | 8/1978 | Ekstedt et al. | 60/39.66 |

*Primary Examiner*—Carlton R. Croyle
*Assistant Examiner*—Edward Look
*Attorney, Agent, or Firm*—E. F. Possessky

[57] ABSTRACT

A combustion chamber for a gas turbine engine having a step-liner configuration and providing a double wall defining an annular confined cooling air flow passage along the outer surface of the chamber. The outer wall of the double-wall configuration is provided by a concentric cylindrical baffle member supported in radially spaced relation from the combustion chamber wall by a plurality of leaf spring members providing a biasing force between the combustion chamber wall and the baffle member so that relative thermal growth between the combustion chamber wall and the baffle can be accommodated by deflection of the support springs or by axial sliding between the springs and the chamber wall.

4 Claims, 5 Drawing Figures

GAS TURBINE COMBUSTION CHAMBER

BACKGROUND OF THE INVENTION

1. Field of the Invention

This invention relates to a combustion chamber for a gas turbine engine and more particularly to a double-wall combustion chamber configuration providing a flow path for convectively cooling the combustion chamber wall.

2. Description of the Prior Art

Cylindrical, step-liner combustion chambers for gas turbines are well known. In such combustion chambers the step-liner configuration defines cylindrical segments extending axially with each downstream segment having a slightly larger diameter than the immediately preceding segment of the combustion chamber and generally with the leading edge of the larger diameter downstream segment overlapping the terminal edge of the upstream segment to define an annular, axially extending airflow path between adjacent segments. The adjacent segments are supported in such configuration by support means extending generally radially between the overlapping portions thereof permitting an entry for cooling air, flowing exteriorly of the combustion chamber, to enter the chamber through the annular passage. Such cooling air, while flowing over the outer surface of the upstream segments, tends to cool the upstream segment by convectively removing the heat therefrom, and, upon entering the annular passage, continues to flow along the inside surface of the downstream segment to form a layer of barrier or film cooling air, protecting the inner surface of the combustion chamber from the combustion gases therewithin. Thus, it is apparent that the cooling provided the downstream segment by such air is not as dependent upon the air having a low temperature as it is upon the air maintaining a protective layer.

In order to increase the effective convective cooling provided by the otherwise randomly circulating air on the exterior surface of the upstream segment, it is desirable to direct the air in close proximity and at relatively high velocity adjacent the exterior surface. Preferably, a certain amount of turbulence will also be established in this cooling air to maximize the cooling effect of the flowing air.

Heretofore, a double-wall step-liner combustion chamber was provided, such as shown in U.S. Pat. No. 3,702,058 having a common assignee as the present invention, wherein an outer annular sleeve or baffle encircled each cylindrical segment of the chamber and was maintained in annular-spaced relation thereabout by an annular corrugated member or wiggle strip, with all components being assembled and welded together to provide an integral structure. However, the variations and gradations in temperatures between the various components (the combustion chamber wall being substantially hotter, and on the order of about 1400° F., than the outer wall, which may be on the order of about 750° F.), resulted in relative thermal expansion therebetween, both axially and radially which, in turn, developed areas of high stress in the respective parts leading to, over and extended period of time, failures thereof.

SUMMARY OF THE INVENTION

The present invention provides an annular baffle member encircling each cylindrical segment of the step-liner combustion chamber and with each baffle member maintained in radially spaced relation to the segment by leaf-spring support members permitting the outer chamber wall to expand both axially and radially without affecting the annular baffle or inducing stress factors therein. Further, the outer surface of each cylindrical segment of the combustion chamber, except in the areas contacted by the leaf spring, has outwardly projecting dimples or projections which induce turbulence in the cooling air flowing in the annular space between the baffle and chamber wall and which also increase the exposed surface area of the chamber wall to increase the heat transfer between the chamber and the air flowing in the passage.

DESCRIPTION OF THE PREFERRED EMBODIMENT

Figure 1:
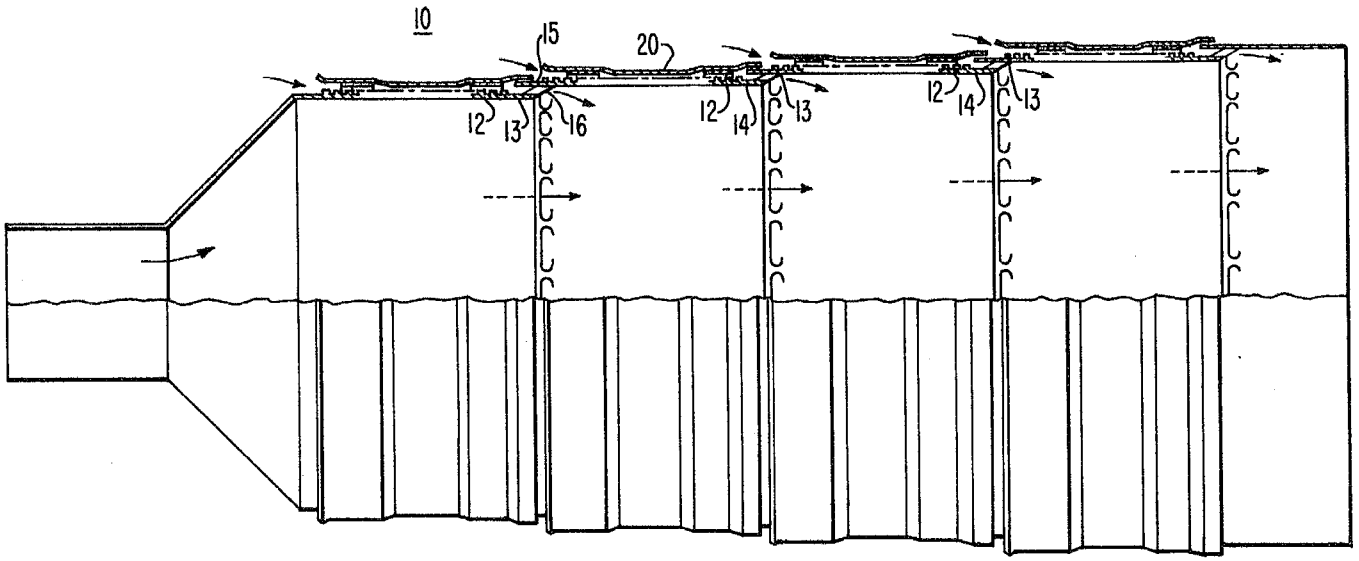
FIG. 1 is an axial cross-sectional view of the combustion chamber of the present invention.
Figure 2:
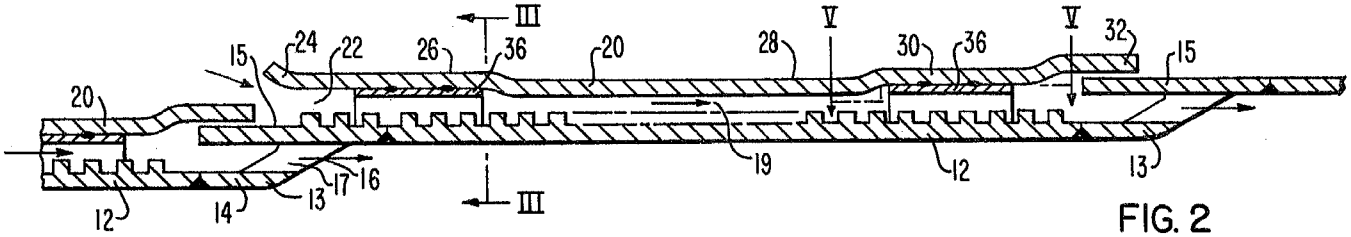
FIG. 2 is an enlarged view of the portion of FIG. 1.

Referring initially to FIGS. 1 and 2 it is seen that the combustion chamber 10 of the present invention is formed of a plurality of cylindrical segments 12 with the inlet or upstream segment having a diameter less than the next adjacent downstream segment which, in turn, has a diameter less than the next adjacent downstream segment. An annular transition ring 13 is interposed between adjacent cylindrical segments which, in axial cross section, provides a generally U-shaped configuration, with one leg 14 thereof attached, as by welding, to the terminal edge of the upstream segment and the opposite leg 15 attached, also by welding, to the leading edge of the downstream segment. The bight or web portion 16 of the annular ring defines a plurality of apertures 17 (more clearly shown in FIGS. 3 and 4) permitting cooling air to enter the downstream chamber at the upstream edge of each segment and, as directed by the openings 17, and flow along the inner face of each segment to provide a film of air thereover. Such configuration provides a step-line cylindrical combustion chamber.

Still referring to FIGS. 1 and 2, it is seen that separate cylindrical baffle members 20 encircle each combustion chamber segment 12 and are maintained in radially uniform spaced relation therewith to define an annular cooling airflow path 19 between the baffle and the outer surface of the segment. More particularly, each baffle member 20 defines an entry or throat area 22 at its upstream end defined by a slightly belled leading edge 24 terminating in a portion 26 stepped outwardly from the axially extending mid-section 28. The terminal portion of each baffle member defines an outwardly stepped axially extending portion 30 terminating in a further outwardly stepped marginal edge 32 which overlaps, in radially close proximity, the outer leg 15 of the annular transition ring 13 to the next adjacent cylindrical segment. Thus, cooling air is directed into the annular space 19, between the baffle member and the cylindrical segment of the combustion chamber and upon exiting is directed into the opening 17 of the annular transition ring to flow along the inside wall of the next adjacent segment as described.

Figure 4:
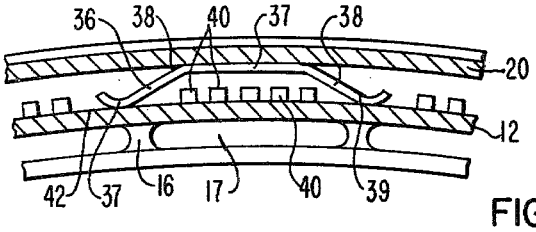
FIG. 4 is an enlarged view of a portion of FIG. 3.
Figure 3:
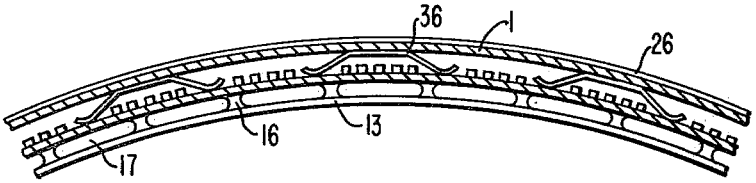
FIG. 3 is a cross-sectional view along line III—III of FIG. 2.

Referring to FIGS. 3 and 4 it is therein seen that each baffle member 20 is maintained in annular-spaced relation to the outer surface of each cylindrical segment by an annular row of a plurality of leaf-spring supports 36. Each leaf spring support defines a mid-portion 37 attached to the inner face of the baffle member (and as seen in FIGS. 1 and 2, two such annular rows are provided and in axial alignment with the outwardly stepped portions adjacent leading and trailing edges) and opposed depending downwardly, outwardly extending arms 38 terminating in a rounded bearing surface 39 freely contacting the outer surface of the combustion chamber segment and with the arms 38 normally biasing the baffle 20 to a radially outer position to maintain the annular space 19 between the baffle and the combustion chamber wall. Thus, it is apparent that radial or axial expansion or contraction of the combustion chamber segment is accommodated without inducing any stresses in the baffle member or baffle supporting springs.

Figure 5:
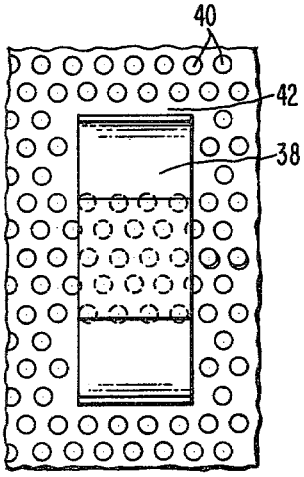
FIG. 5 is a view along line V—V of FIG. 2.

It will be noted in FIGS. 1 and 4 that the outer surface of each combustion chamber segment defines a pattern of outwardly projecting pins or dimples 40. Such pins preferably do not extend the full radial width of the annular passage 19, but do project sufficiently into the cooling airflow path to induce turbulent flow. Such pins 40 also increase the surface area of the combustion chamber segment exposed to the cooling air, with both effects increasing the convection cooling capacity of the air flowing through the annular space. However, the portion of the outer surface of each segment on which the spring arms 38 bear is maintained smooth as at 42 (clearly seen in FIG. 5) so that the arms 38 are relatively free to move (at least within the bounds of the normally expected relative thermal expansion) to accommodate both radial and axial relative growth therebetween without being contacted or interfered with by the projections 40. Such smooth areas also trap the spring ends 39 for indexed receipt thereof and proper positioning of the baffle members upon assembly of the baffle members and the combustion chamber.

Thus, a double-wall step-liner configuration is provided for a combustion chamber with the inner or combustion chamber wall free to expand or contract independently of and without inducing stress into the outer air flow baffle, thereby improving the cooling effectiveness of the exteriorly flowing air without inducing failure-causing stresses in the assembly.

I claim:

1. A combustion chamber for a combustion turbine engine, said chamber defining a generally cylindrical configuration having an inlet end and an opposed discharge end and with a portion intermediate the opposed ends defining an outwardly stepped configuration comprising a plurality of axially extending serially arranged cylindrical segments with each downstream segment having a larger diameter than the adjacent upstream segment and annular transition means integrally connecting the trailing edge of each downstream segment to the leading edge of each adjacent upstream segment, said annular transition means defining apertures for admitting air therethrough into said chamber;

a cylindrical baffle means encircling each cylindrical segment in spaced relation therewith defining an annular airflow passage therebetween, said baffle means axially extending from generally adjacent the upstream transition means to generally adjacent the openings in the downstream transition means whereby air flowing through said passage is directed into said downstream openings in said transition piece;

a plurality of spring means interposed in said passage between each segment and said encircling baffle means and biased to maintain a separating force therebetween, said spring means attached only to either said baffle means or said segment to accommodate relative thermal growth both radially and axially between said segment and baffle means;

said plurality of spring means including a plurality of generally circumferentially oriented leaf spring elements forming an annular array, with a pair of such arrays respectively disposed generally adjacent the upstream and downstream portions of each baffle means; and abutment means for limiting axial movement of the free ends of said leaf spring elements and thereby limiting relative axial movement of said baffle means and said segments.

2. Combustion structure according to claim 1 wherein each of said annular transition means includes a generally U-shaped transition ring having a radially inner wall coterminous with and joined to the terminal edge of said upstream segment and a radially outer wall coterminous with and joined to the initial edge of said downstream segment and a bight portion interconnecting said inner and outer wall and wherein said transition apertures are formed in said bight portion.

3. A combustion chamber for a combustion turbine engine, said chamber defining a generally cylindrical configuration having an inlet end and an opposed discharge end and with a portion intermediate the opposed ends defining an outwardly stepped configuration comprising a plurality of axially extending serially arranged cylindrical segments with each downstream segment having a larger diameter than the adjacent upstream segment and annular transition means integrally connecting the trailing edge of each downstream segment to the leading edge of each adjacent upstream segment, said annular transition means defining apertures for admitting air therethrough into said chamber;

a cylindrical baffle means encircling each cylindrical segment in spaced relation therewith defining an annular airflow passage therebetween, said baffle means axially extending from generally adjacent the upstream transition means to generally adjacent the openings in the downstream transition means whereby air flowing through said passage is directed into said downstream openings in said transition piece;

a plurality of spring means interposed in said passage between each segment and said encircling baffle means and biased to maintain a separating force therebetween, said spring means attached only to either said baffle means or said segment to accommodate relative thermal growth both radially and axially between said segment and baffle means;

said outer wall of said transition means extending axially in the upstream direction, the terminal portion of each baffle means overlapping the leading edge of said outer wall and in slightly spaced annular relationship to direct air flowing through said annular airflow passage into said apertures, said slightly spaced annular relationship accommodating radial expansion of said transition means.

4. Combustion structure according to claim 3 wherein abutment means are provided for limiting axial movement of the free ends of said spring means and thereby limiting the relative axial movement of said baffle means and said segments.

* * * * *